US009057311B2

(12) United States Patent
Horimura et al.

(10) Patent No.: US 9,057,311 B2
(45) Date of Patent: Jun. 16, 2015

(54) HONEYCOMB UNIT FOR EXHAUST EMISSION CONTROL

(75) Inventors: Hiroyuki Horimura, Wako (JP); Daiji Kawaguchi, Wako (JP); Satoru Suwa, Wako (JP); Katsuhiro Iwane, Koshi (JP); Takafumi Kozaiku, Koshi (JP)

(73) Assignees: HONDA MOTOR CO., LTD., Tokyo (JP); GOSHI GIKEN CO., LTD., Koshi-Shi (JP)

( * ) Notice: Subject to any disclaimer, the term of this patent is extended or adjusted under 35 U.S.C. 154(b) by 407 days.

(21) Appl. No.: 13/435,001

(22) Filed: Mar. 30, 2012

(65) Prior Publication Data

US 2012/0247076 A1 Oct. 4, 2012

(30) Foreign Application Priority Data

Mar. 31, 2011 (JP) ..... 2011-079744

(51) Int. Cl.

| | |
|---|---|
| ***F01N 3/022*** | (2006.01) |
| ***F01N 3/28*** | (2006.01) |
| ***B01J 35/04*** | (2006.01) |

(52) U.S. Cl.

CPC ..... *F01N 3/2842* (2013.01); *B01J 35/04* (2013.01); *F01N 3/281* (2013.01); *F01N 2260/10* (2013.01)

(58) Field of Classification Search

None

See application file for complete search history.

(56) References Cited

U.S. PATENT DOCUMENTS

| | | | | |
|---|---|---|---|---|
| 5,259,190 | A * | 11/1993 | Bagley et al. | 60/300 |
| 5,593,646 | A * | 1/1997 | Koshiba et al. | 422/177 |
| 7,410,521 | B2 * | 8/2008 | Sellers et al. | 55/523 |
| 8,465,566 | B2 * | 6/2013 | Maus et al. | 55/523 |

FOREIGN PATENT DOCUMENTS

| | | | |
|---|---|---|---|
| JP | 2709789 | B2 | 2/1998 |
| JP | 10-076165 | A | 3/1998 |
| JP | 2007-007585 | A | 1/2007 |

* cited by examiner

*Primary Examiner* — Duane Smith

*Assistant Examiner* — Phillip Shao

(74) *Attorney, Agent, or Firm* — Birch, Stewart, Kolasch & Birch, LLP

(57) ABSTRACT

A metal honeycomb structure includes planar and corrugated sheets brazed together at first and second joining portions made of brazing materials applied to the corrugated sheet. The first and second joining portions are located proximate exhaust inlet and outlet of the honeycomb structure. The honeycomb further includes a joining strip joined to a metal outer tube. The joining strip is made of a brazing material applied to an inner wall of the metal outer tube. The second joining portion overlaps the joining strip and has a brazing length larger than a brazing length of the first joining portion which does not overlap the joining strip.

3 Claims, 6 Drawing Sheets

HONEYCOMB UNIT FOR EXHAUST EMISSION CONTROL

FIELD OF THE INVENTION

The present invention relates to an improvement in a honeycomb unit for exhaust emission control.

BACKGROUND OF THE INVENTION

Honeycomb units for exhaust emission control have metal outer tubes and metal honeycomb structures pressed into and joined to the tubes, as disclosed in JP-B-2709789.

The metal carrier (hereinafter referred to as "honeycomb unit") disclosed in JP-B-2709789 includes a metal outer tube and a honeycomb structure pressed into and joined to the metal outer tube. The honeycomb structure has a planar sheet and a corrugated sheet placed on the planar sheet and wound together with the planar sheet.

The metal outer tube is brazed to the honeycomb structure through brazing materials at locations between the metal outer tube and the honeycomb structure. The planar sheet is brazed to the corrugated sheet through brazing materials at locations between the planar sheet and the corrugated sheet. The brazing material at each location between the metal outer tube and the honeycomb structure is the same in length as the brazing material each location between the planar sheet and the corrugated sheet.

For the honeycomb unit in JP-B-2709789, the honeycomb structure has a temperature which increases by heat of exhaust gas passing therethrough. This increase in temperature of the honeycomb structure is followed by increase in temperature of the metal outer tube. Likewise, decrease in temperature of the honeycomb structure is followed by decrease in temperature of the metal outer tube.

The brazing materials are arranged without taking account of reaction between the metal outer tube and the honeycomb structure during the change in temperature of the honeycomb structure and the outer tube.

There is a need of brazing material arrangement accommodating the temperature change.

SUMMARY OF THE INVENTION

According to one aspect of the present invention, there is provided a honeycomb unit for exhaust emission control, comprising: a metal outer tube; and a metal honeycomb structure pressed into and joined to the metal outer tube, the metal honeycomb structure including: a joining strip joined to the metal outer tube; a planar sheet; a corrugated sheet placed on the planar sheet, the corrugated sheet and the planar sheet being wound together, the corrugated sheet including an outer surface having crests and an inner surface having crests; first and second joining portions brazing the planar sheet and the corrugated sheet together; the first joining portion and the second joining portion being located proximate opposing ends of the metal honeycomb structure; the first joining portion including first joining sections formed of brazing materials applied to the crests of the outer surface of the corrugated sheet and second joining sections formed of brazing materials applied to the crests of the inner surface of the corrugated sheet; the second joining portion including first joining sections formed of brazing materials applied to the crests of the outer surface of the corrugated sheet and second joining sections formed of brazing materials applied to the crests of the inner surface of the corrugated sheet; the first joining sections of the first joining portion and the first joining sections of the second joining portion being offset from the second joining sections of the first joining portion and the second joining sections of the second joining portion in directions parallel to an axis of the metal honeycomb structure; the second joining portion and the joining strip overlapping, the first joining portion and the joining strip not overlapping; the first joining portion having a first brazing length along the axis of the metal honeycomb structure; the second joining portion having a second brazing length along the axis of the metal honeycomb structure; and the second brazing length of the second joining portion being larger than the first brazing length of the first joining portion.

Of the first and second joining portions located proximate opposing ends of the honeycomb structure, the second joining portion overlaps the joining strip joined to the metal outer tube. The first joining portion does not overlap the joining strip. The second joining portion has the brazing length larger than the brazing length of the first joining portion.

The second joining portion located overlapping the joining strip which is to be subjected to a greater force has the larger brazing length to thereby improve rigidity of the honeycomb structure so as to prevent deformation of the honeycomb structure.

The joining strip which is required to provide high strength to firmly join the honeycomb structure and the metal outer tube has a sufficient brazing length to accommodate change in temperature of the metal outer tube and the honeycomb structure. The first joining portion located opposite the joining strip is least influenced by the outer metal tube and thus has the smaller brazing length for saving an amount of brazing material used. The brazing material of the honeycomb unit according to the one aspect of the present invention is thus arranged to accommodate the change in temperature of the metal outer tube and the honeycomb structure.

According to a second aspect of the present invention, there is provided a honeycomb unit for exhaust emission control, comprising: a metal outer tube; and a metal honeycomb structure pressed into and joined to the metal outer tube, the metal honeycomb structure including: a joining strip joined to the metal outer tube; a planar sheet; a corrugated sheet placed on the planar sheet, the corrugated sheet and the planar sheet being wound together, the corrugated sheet including an outer surface having crests and an inner surface having crests; first and second joining portions brazing the planar sheet and the corrugated sheet together; the first joining portion and the second joining portion being located proximate opposing ends of the metal honeycomb structure; the first joining portion including first joining sections formed of brazing materials applied to the crests of the outer surface of the corrugated sheet and second joining sections formed of brazing materials applied to the crests of the inner surface of the corrugated sheet; the second joining portion including first joining sections formed of brazing materials applied to the crests of the outer surface of the corrugated sheet and second joining sections formed of brazing materials applied to the crests of the inner surface of the corrugated sheet; the first joining sections of the first joining portion and the first joining sections of the second joining portion being offset from the second joining sections of the first joining portion and the second joining sections of the second joining portion in directions parallel to an axis of the metal honeycomb structure; the corrugated sheet being joined through the planar sheet to the joining strip; the joining strip overlapping the first joining sections of the second joining portion in a direction orthogonal to the axis of the metal honeycomb structure; the joining strip having a brazing length along the axis of the metal honeycomb structure; the first joining sections of the second joining portion each having a brazing length along the axis of the honeycomb structure; the brazing length of the joining strip being larger than the brazing length of each of the first joining sections of the second joining portion.

As for a conventional honeycomb structure having a joining strip joined to a metal outer tube, joining portions between adjacent planar and corrugated sheets of the structure each have a length larger or equal to a length of the joining strip.

In contrast to the conventional honeycomb structure, the joining strip has the brazing length larger than the brazing length of each of the first joining sections of the second joining portion and overlaps the joining sections of the second joining portion in the direction orthogonal to the axis of the honeycomb structure. With the joining strip overlapping the first joining sections of the second joining portion in the direction orthogonal to the axis of the honeycomb structure, the honeycomb structure has increased rigidity to prevent deformation of the honeycomb structure.

The brazing length of the joining strip required to provide high strength to firmly join the honeycomb structure and the metal outer tube is sufficiently large to accommodate change in temperature of the metal outer tube and the honeycomb structure. The first joining portion located opposite the joining strip is least influenced by the outer metal tube has the smaller brazing length for saving an amount of brazing material used. The brazing material of the honeycomb unit according to the second aspect of the present invention is thus arranged to accommodate the change in temperature of the metal outer tube and the honeycomb structure.

Preferably, one of the opposing ends of the metal honeycomb structure defines an exhaust outlet of the honeycomb structure, and the joining strip is disposed only on a side of the exhaust outlet.

It is because the joining strip is disposed only on the side of the exhaust outlet that the metal honeycomb structure is allowed to expand moving toward a front side of the metal outer tube when the honeycomb structure increases in temperature. This expansion and movement can reduce a load on the metal honeycomb structure.

Preferably, the first joining sections of the second joining portion are located on the side of the exhaust outlet, the first joining sections of the second joining portion have rear ends, and the joining strip has a rear end located rearward of the rear ends of the first joining sections of the second joining portion.

The rear end of the joining strip located rearward of the rear ends of the first joining sections is closer to the exhaust outlet than to the exhaust inlet. This location of the rear end of the joining strip is one where a temperature can increase less than any other part of the honeycomb structure. The location of the rear end rearward of the rear ends of the first joining sections can maintain joining strength between the metal honeycomb structure and the metal outer tube, unlike in the case of the rear end being located forward of the rear ends of the first joining sections.

Preferably, the first joining sections of the first joining portion are arranged adjacent the second joining sections of the first joining portion in directions parallel to the axis of the honeycomb structure without overlapping the second joining sections of the first joining portion in directions orthogonal to the axis of the honeycomb structure, and the first joining sections of the second joining portion are arranged adjacent the second joining sections of the second joining portion in directions parallel to the axis of the honeycomb structure without overlapping the second joining sections of the second joining portion in directions orthogonal to the axis of the honeycomb structure.

This arrangement of the adjacent first and second joining sections allows elongation of the honeycomb structure, unlike in the case of the first and second joining sections overlapping. The elongated honeycomb structure can be subjected to the least force to thereby improve durability of the honeycomb structure.

BRIEF DESCRIPTION OF THE DRAWINGS

Certain preferred embodiments of the present invention will hereinafter be described in detail, by way of example only, with reference to the accompanying drawings, in which.

DETAILED DESCRIPTION OF THE PREFERRED EMBODIMENTS

Referring to FIGS. 1 to 5, there is shown a honeycomb unit 10 for exhaust emission control in a first embodiment of the present invention. The honeycomb unit 10 includes a metal honeycomb structure 11 and a metal outer tube 12 encircles the honeycomb structure 11.

Figure 1:
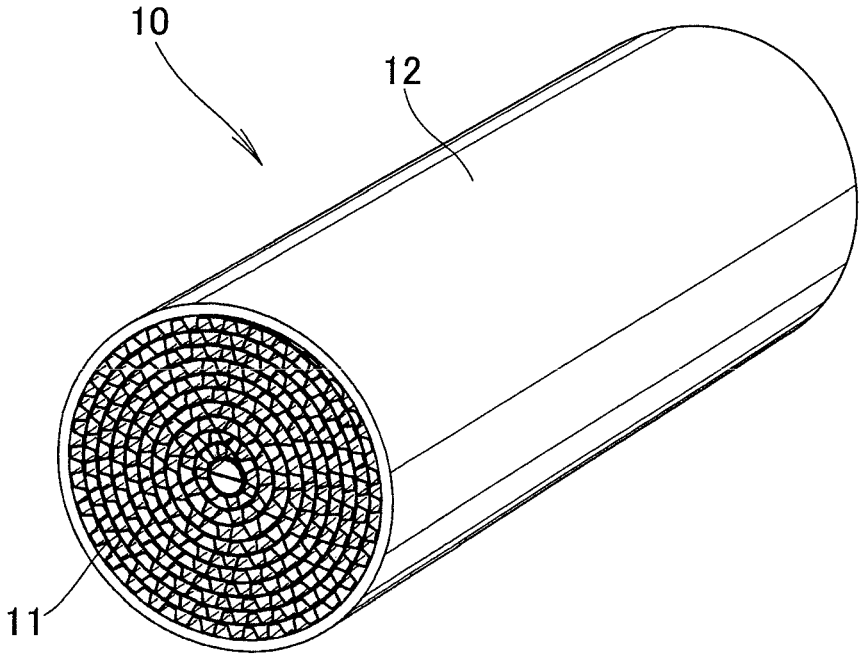
FIG. 1 is a perspective view of a honeycomb unit for exhaust emission control in a first embodiment of the present invention.
Figure 4:
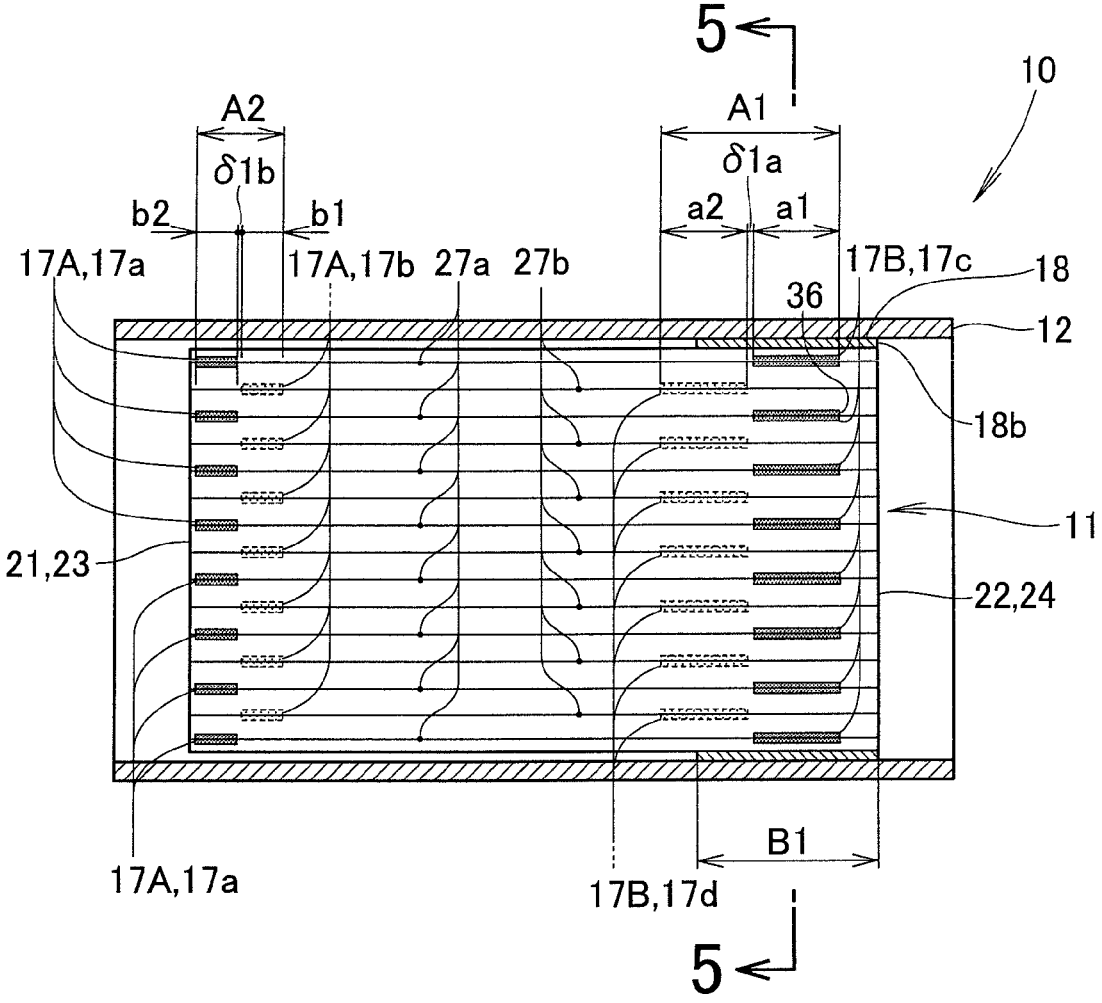
FIG. 4 is a view showing how a joining strip is positioned relative to joining portions of the metal honeycomb structure.
Figure 5:
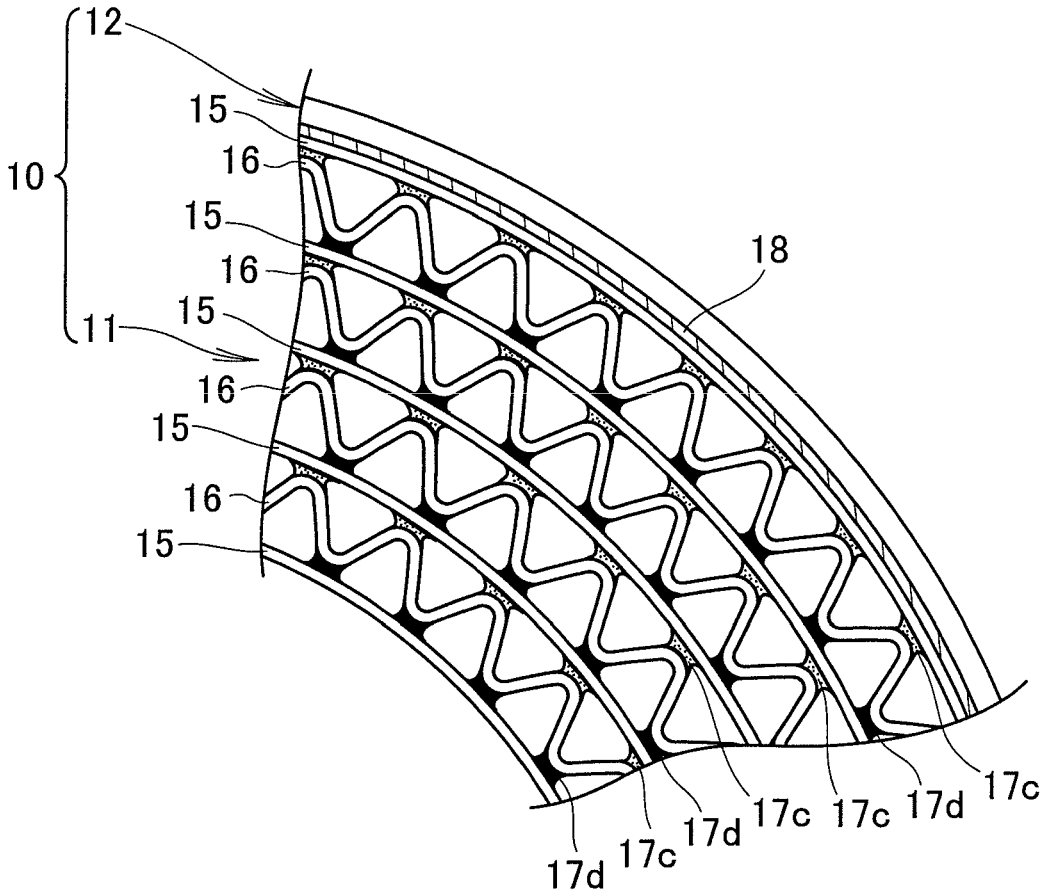
FIG. 5 is a cross-sectional view taken along line 5-5 of FIG. 4.

As shown in FIGS. 1, 4 and 5, the metal honeycomb structure 11 includes a metal planar sheet 15 and a metal corrugated sheet 16 placed on the planar sheet 15 and spirally wound together with the planer sheet 15. The honeycomb structure 11 is pressed into and firmly joined to the outer tube 12.

The planer sheet 15 and the corrugated sheet 16 are joined together by first and second joining portions 17A, 17B of the honeycomb structure 11, as detailed later. The honeycomb structure 11 is joined to the metal outer tube 12 through a joining strip 18 as detailed later.

Figure 2:
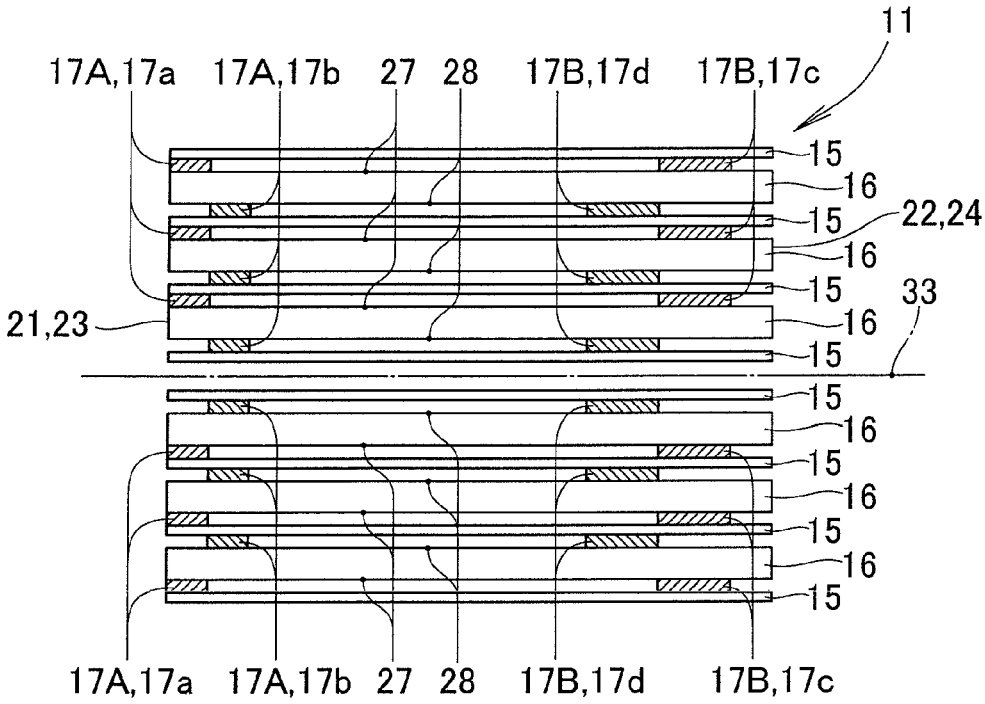
FIG. 2 is a diagrammatical cross-sectional view of a metal honeycomb structure of the honeycomb unit shown in FIG. 1.

Turning to FIGS. 2 and 5, the planar sheet 15, which provides a core of the honeycomb structure 11, is spirally wound on a central axis 33 of the honeycomb structure 11. The corrugated sheet 16 is wound extending between adjacent turns of the wound planer sheet 15. The corrugated sheet 16 is brazed to the planar sheet 15 by the first joining portion 17A disposed closely to an exhaust inlet 21 of the honeycomb structure 11 and by the second joining portion 17B disposed closely to an exhaust outlet 22 of the honeycomb structure 11.

More specifically, the first and second joining portions 17A, 17B are located proximate opposing ends 23, 24 of the honeycomb structure 11 and braze the planar sheet 15 and the corrugated sheet 16 together therethrough. The first joining portion 17A includes first joining sections 17*a* formed of brazing materials applied to crests of an outer surface 27 of the corrugated sheet 16 and second joining sections 17*b* formed of brazing materials applied to crests of an inner surface 28 of the corrugated sheet 16. The second joining portion 17B includes first joining sections 17*c* formed of brazing materials applied to the crests of the outer surface 27 of the corrugated sheet 16 and second joining sections 17*d* formed of brazing materials applied to the crests of the inner surface 28 of the corrugated sheet 16.

The first joining sections 17*a* are offset from the second joining sections 17*b* in directions parallel to the central axis 33 of the honeycomb structure 11. The first joining sections 17*c* are offset from the second joining sections 17*d* in directions parallel to the central axis 33 of the honeycomb structure 11.

Figure 3:
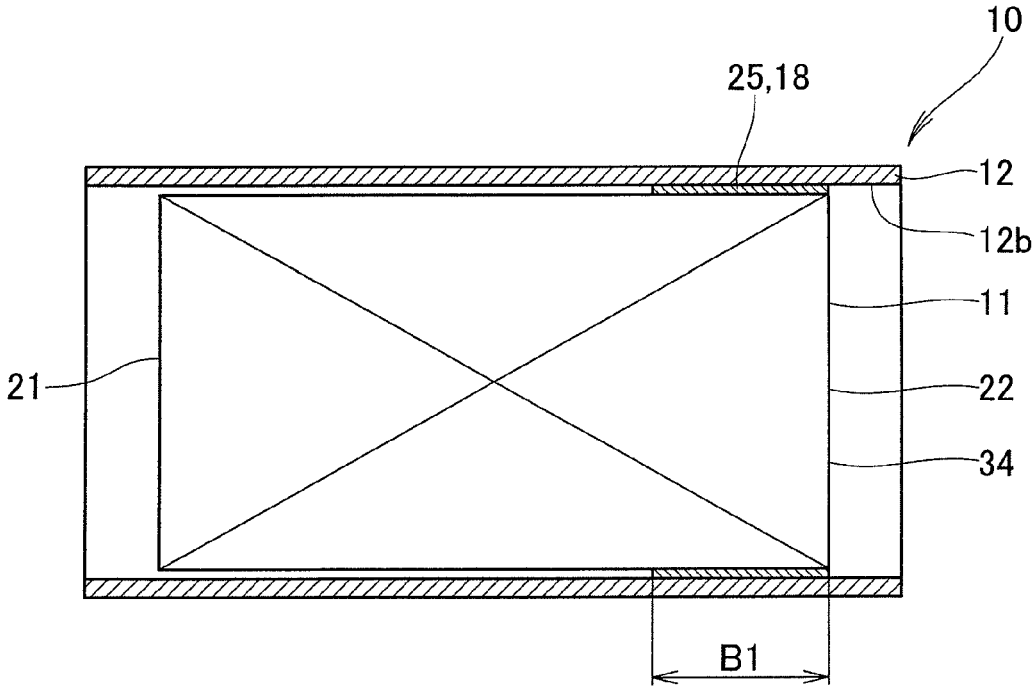
FIG. 3 is a cross-sectional view of the honeycomb unit with the metal honeycomb structure joined to a metal outer tube.

As shown in FIG. 3, the joining strip 18 is formed of a brazing material 25 joined to the metal outer tube 12. The joining strip 18 is disposed only on a side of the exhaust outlet 22 defined by one end 34 of the honeycomb structure 11. The joining strip 18 has a length B1 from the one end 34 toward the exhaust inlet 21 along the axis 33 of the honeycomb structure 11.

Turning to FIG. 4, the second joining portion 17B located closely to the exhaust outlet 22 overlaps the joining strip 18. The first joining portion 17A is offset away from the joining strip 18 in the direction parallel to the axis 33 (FIG. 2) of the honeycomb structure 11 without overlapping the joining strip 18.

The first joining portion 17A has a first brazing length A2−δ1*b* along the central axis 33 of the honeycomb structure 11. The first brazing length A2−δ1*b* is defined as the sum of a brazing length b2 of one of the first joining sections 17*a* and a brazing length b1 of one of the second joining sections 17*b*. The second joining portion 17B has a second brazing length A1−δ1*a* along the central axis 33 of the honeycomb structure 11. The second brazing length A1−δ1*a* is defined as the sum of a brazing length a1 of one of the first joining sections 17*c* and a brazing length a2 of one of the second joining sections 17*d*.

The term "brazing length" of the joining portion means a length the joining portion extends in the direction parallel to the axis 33 of the honeycomb structure 11.

The second brazing length A1−δ1*a* of the second joining portion 17B is larger than the first brazing length A2−δ1*b* of the first joining portion 17A (i.e., (A2−δ1*b*)<(A1−δ1*a*)). The δ1*a* is defined as a distance by which each of the first joining sections 17*a* is offset away from each of the second joining sections 17*b* in a direction parallel to the central axis 33 of the honeycomb structure 11. Similarly, the δ1*b* is defined as a distance by which each of the first joining sections 17*c* is offset away from each of the second joining sections 17*d* in the direction parallel to the central axis 33 of the honeycomb structure 11. This distance designated at δ1*a* or δ1*b* is hereinafter referred to as "clearance".

The joining strip 18 located on a side of the exhaust outlet 22 has a rear end 18*b*. The first joining sections 17*c* located on the side of the exhaust outlet 22 have rear ends 36. The rear end 18*b* of the joining strip 18 is located rearward of the rear ends 36 of the first joining sections 17*c*.

The first joining sections 17*a* on one surface 27*a* of the corrugated sheet 16 are arranged adjacent the second joining sections 17*b* on an opposite surface 27*b* of the corrugated sheet 16, in directions parallel to the central axis 33 of the honeycomb structure 11. The first joining sections 17*c* on the one surface 27*a* of the corrugated sheet 16 are arranged adjacent the second joining sections 17*d* on the opposite surface 27*b* of the corrugated sheet 16, in the directions parallel to the central axis 33 of the honeycomb structure 11.

Each of the first joining sections 17*a* is offset away from each of the second joining sections 17*b* by the clearance δ1*b*. Each of the first joining sections 17*c* is offset away from each of the second joining sections 17*d* by the clearance δ1*a*.

The joining strip 18 joined to the metal outer tube 12 overlaps the second joining portion 17B having the brazing length A1−δ1*a* larger than the first brazing length A2−δ1*b* of the first joining portion 17A which does not overlap the joining strip 18. The larger length of the joining portion overlapping the joining strip 18 which could be subjected to a greater force improves rigidity of the honeycomb structure 11 to thereby prevent deformation of the honeycomb structure 11.

Since the joining strip 18 is disposed only on the side of the exhaust outlet 22, the metal honeycomb structure 11 is allowed to expand moving toward a front side of the metal outer tube 12 when the honeycomb structure 11 increases in temperature. This expansion and movement reduces a load on the metal honeycomb structure 11.

The rear end 18*b* of the joining strip 18 located rearward of the rear ends 36 of the first joining sections 17*c* is closer to the exhaust outlet 22 than to the exhaust inlet 21. The location of the rear end 18*b* of the joining strip 18 is one where a temperature can increase less than any other part of the honeycomb structure 11. The location of the rear end 18*b* located rearward of the rear ends 36 of the first joining sections prevents deterioration of joining strength between the metal honeycomb structure 11 and the metal outer tube 12, unlike in the case of the rear end 18*b* being located forward of the rear ends 36 of the first joining sections 17*c*.

With the first joining section 17*a* offset from the adjacent second joining section 17*b* by the clearance δ1*b*, the honeycomb structure 11 can be elongated, unlike in the case of the adjacent first and second joining sections 17*a*, 17*b* overlapping. The elongated honeycomb structure 11 can be subjected to the least force to thereby improve durability of the honeycomb unit 10.

Figure 6A:
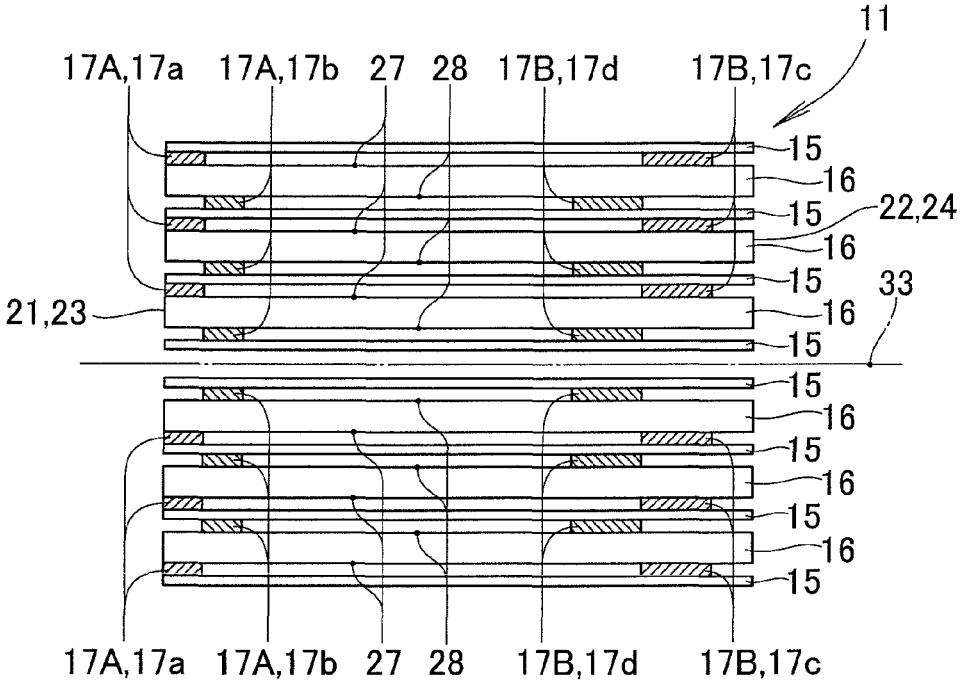
FIG. 6A is a diagrammatical cross-sectional view of a metal honeycomb structure of a honeycomb unit for exhaust emission control in a second embodiment of the present invention.

Referring to FIG. 6A, there is shown a metal honeycomb structure 11 in a second embodiment of the present invention. The metal honeycomb structure 11 includes a planar sheet 15 and a corrugated sheet 16 brazed to the planar sheet 15 through first and second joining portions 17A, 17B located proximate exhaust inlet and outlet 21, 22 of the honeycomb structure 11. The first and second joining portions 17A, 17B are formed of brazing materials applied to the corrugated sheet 16, as detailed below.

The first joining portions 17A, 17B are located proximate opposing ends of the metal honeycomb structure 11. The first joining portion 17A includes first joining sections 17*a* formed of brazing materials applied to an outer surface 27 of the corrugated sheet 16 and second joining sections 17*b* formed of brazing materials applied to an inner surface 28 of the corrugated sheet 16. The second joining portion 17B includes first joining sections 17*c* formed of brazing materials applied to the outer surface 27 of the corrugated sheet 16 and second joining sections 17*d* formed of brazing materials applied to the inner surface 28 of the corrugated sheet 16.

The first joining sections 17*a* are offset from the second joining sections 17*b* in directions parallel to a central axis 33 of the metal honeycomb structure 11. The first joining sections 17*c* are offset from the second joining sections 17*d* in directions parallel to the central axis 33 of the honeycomb structure 11.

Figure 6B:
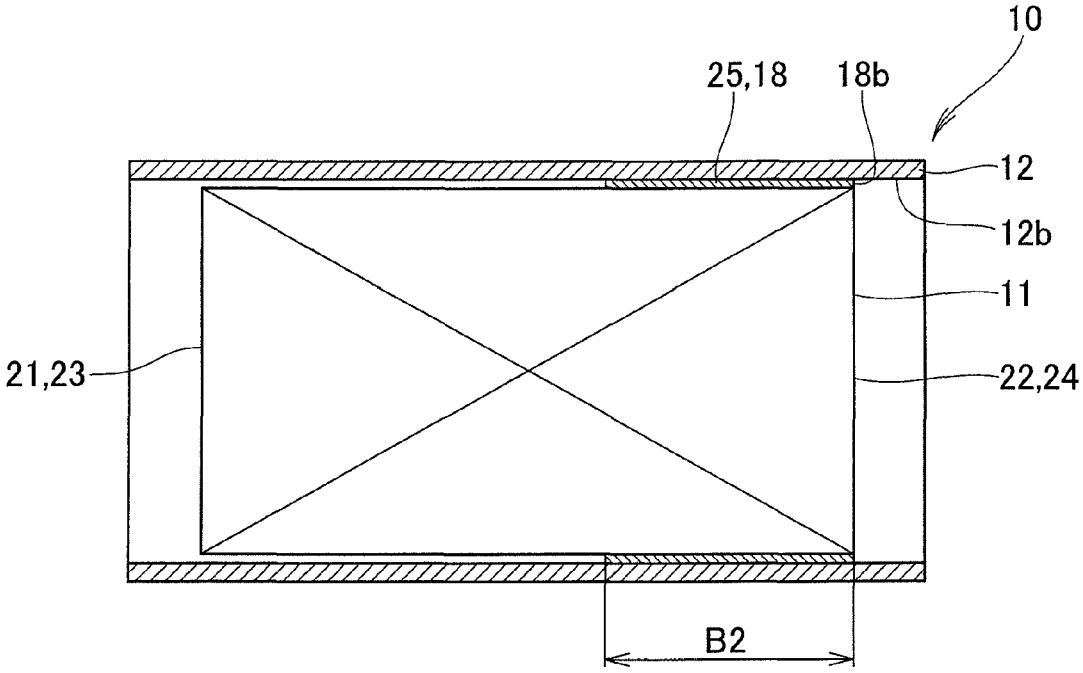
FIG. 6B is a cross-sectional view of the honeycomb unit of FIG. 6A with the metal honeycomb structure joined to a metal outer tube.

Turning to FIG. 6B, the honeycomb structure 11 includes a joining strip 18 joined to a metal outer tube 12. The joining strip 18 is formed of a brazing material on an inner wall 12*b* of the metal outer tube 12. The joining strip 18 overlaps the second joining portion 17B in a direction orthogonal to the central axis 33 of the honeycomb structure 11. The joining strip 18 has a brazing length B2 larger than a brazing length of the joining portion 17B.

Figure 7:
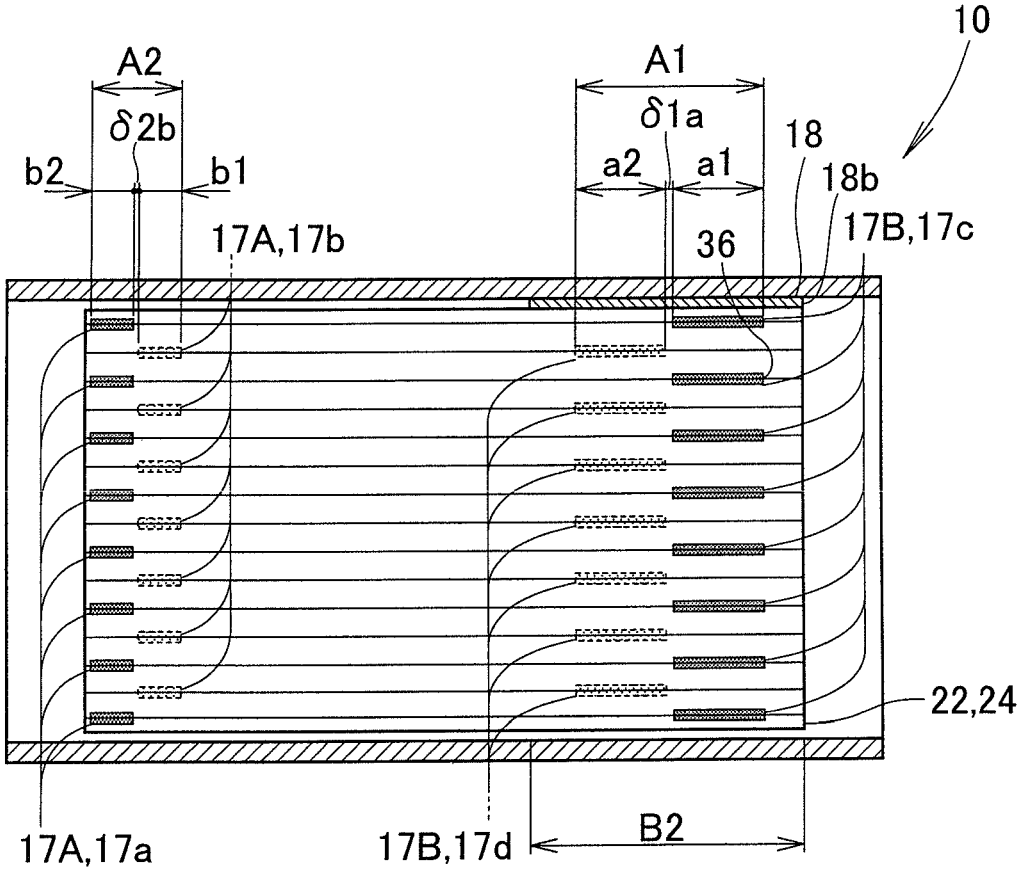
FIG. 7 is a view showing how a joining strip is positioned relative to joining portions of the metal honeycomb structure of the honeycomb unit in the second embodiment.

More specifically, as shown in FIG. 7, the joining strip 18 overlaps all of the joining sections 17*c*, 17*d* of the joining section 17B and has the brazing length B2 larger than the brazing length A1−δ1*a* of the joining portion 17B.

As for a conventional honeycomb structure, adjacent planar and corrugated sheets are joined together at joints arranged in the form of spots or in a staggered form. The honeycomb structure is joined to a metal outer tube through a joining strip. Each of the joints has a length larger than a length of the joining strip.

As for the honeycomb structure in the present invention, however, the joining strip 18 joined to the metal outer tube 12 overlaps all of the joining sections 17*c*, 17*d* of the joining portion 17B and has the brazing length B2 larger than the brazing length A1−δ1*a* of the joining portion 17B ((A1−δ1*a*) <B2). It is because the joining portion 17B underlies the joining strip 18 throughout that the metal honeycomb structure 11 has improved strength to prevent deformation of the honeycomb structure 11.

Since the joining strip 18 is disposed only on the side of the exhaust outlet 22, the metal honeycomb structure 11 is allowed to expand moving toward a front side of the metal outer tubular member 12 when the honeycomb structure 11 increases in temperature. This expansion and movement reduces a load on the metal honeycomb structure 11.

The joining strip 18 has a rear end 18*b* located rearward of the rear ends 36 of the first joining sections 17*c* and closer to the exhaust outlet 22 than to the exhaust inlet 21. This location of the rear end 18*b* of the joining strip 18 is one where a temperature can increase less than any other part of the honeycomb structure 11. The location of the rear end 18*b* rearward of the rear ends 36 of the first joining sections 17*c* maintains joining strength between the metal honeycomb structure 11 and the metal outer tube 12, unlike in the case of the rear end 18*b* being located forward of the rear ends 36 of the first joining sections 17*c*.

With the first joining section 17*a* offset away from the adjacent second joining section 17*b* by the clearance δ1*a*, the honeycomb structure 11 can be elongated, unlike in the case of the adjacent first and second joining sections 17*a*, 17*b* overlapping. The elongated honeycomb structure 11 can be subjected to the least force to thereby improve durability of the honeycomb unit 10.

Examples 1 to 4 below show experimental data in support of the advantages provided by the honeycomb unit of the present invention.

Example 1

A planar sheet was prepared. A 40 μm stainless steel foil sheet was machined to provide a corrugated sheet. Paste of brazing material prepared from a solvent and a binder was applied to predetermined points on crests of the corrugated sheet. Then, the planar sheet and the corrugated sheet are placed on one another and wound together into a honeycomb core of ϕ40×L 90. The honeycomb core was inserted into and brazed to an outer tube in a vacuum furnace to provide a honeycomb unit for exhaust emission control. It is noted that the honeycomb core was brazed to the outer tube through a joining strip of brazing material.

The honeycomb core had inlet and outlet side joining portions brazing the corrugated sheet to the planar sheet. The inlet side joining portion was 4 mm away from an inlet end of the honeycomb core and the outlet joining portion was 4 mm away from an outlet end of the honeycomb core. The joining strip between the honeycomb core and the outer tube had a length of 20 mm from the outlet end of the honeycomb core.

Each of the inlet side joining portion and the outlet side joining portion included outer joining sections on an outer side of the corrugated sheet and inner joining sections on an inner side of the corrugated sheet. The outer joining sections and the inner joining sections were arranged in a staggered form. The term "staggered form" hereinafter means that each of the outer joining sections is offset by a clearance (2 mm in Example 1) from the adjacent one of the inner joining sections in a direction parallel to a central axis of the honeycomb core. It is noted that the joining sections on the outer side of the corrugated sheet were located on the side of the outlet end of the honeycomb core.

Ten samples of the honeycomb unit were prepared as shown in Table 1 below. These samples had different brazing lengths (b1, b2, a1, a2) of the joining sections of each of the inlet side joining portion and outlet side joining portion. Of these ten samples, samples J-(1) to J-(5) were made in accordance with the present invention. Samples H-(1) to H-(5) were comparative ones.

Each of the samples was tested by undergoing vibrations of 20 G to 60 G in a temperature cycle process (1000 to 2000 cycles of high and low temperatures of 200° C. to 1000° C.) for evaluation of strength and cell deformation of the tested sample. The evaluation of strength of the sample was made based on amounts of cracks on the sample in comparison with a conventional standard. The evaluation of cell deformation of the sample was made in comparison with a conventional standard. In addition, an amount of brazing material used in each sample was evaluated. Based on the evaluated strength, cell deformation and amount of used brazing material, a comprehensive evaluation of the sample was made.

TABLE 1

| | Brazing Length | | Test Result | | Amount of | |
|---|---|---|---|---|---|---|
| | Inlet Side (b1, b2) | Outlet Side (a1, a2) | Strength | Cell Deformation | Brazing Materials Used | Comprehensive Evaluation |
| H-(1) | 5 | 1 | No Good | Good | Very Good | No Good |
| H-(2) | 5 | 3 | No Good | Good | Very Good | No Good |
| H-(3) | 5 | 5 | No Good | Good | Good | No Good |
| J-(1) | 5 | 7 | Good | Good | Good | Good |
| J-(2) | 5 | 10 | Very Good | Good | Good | Very Good |
| H-(4) | 1 | 10 | Fair | Good | Good | No Good |
| J-(3) | 2 | 10 | Very Good | Good | Good | Very Good |
| J-(4) | 3 | 10 | Very Good | Good | Good | Very Good |
| J-(5) | 7 | 10 | Very Good | Fair | Fair | Good |
| H-(5) | 10 | 10 | Very Good | No Good | No Good | No Good |

Table 1 shows the test result indicating the evaluation of the strength and cell deformation, the evaluation of the amount of brazing material used and the comprehensive evaluation for each sample.

From Table 1, it was found that the joining sections of the outlet side joining portion were required to have a brazing length (a1, a2) larger than 7 mm. Preferably, a brazing length (a1, a2) is 10 mm. Also, it turned out that the brazing length (b1, b2) of the joining sections of the inlet side joining portion scarcely relates to the strength. Table 1 indicates that the cell deformation is somewhat greater when the brazing length (b1, b2) is 7 mm or more. A shorter brazing length is cost-effective because it provides a small amount of brazing material used. However, with the brazing length (b1, b2) of 1 mm, the comprehensive evaluation was "No Good". This is because the brazing length of 1 mm caused partially failed braze between the planer sheet and the corrugated sheet. Thus, the brazing length (b1, b2) should be 7 mm or less, preferably, 2 mm to 5 mm.

Example 2

A planar sheet was prepared. A 40 μm stainless steel foil sheet was machined to provide a corrugated sheet. Paste of brazing material prepared from a solvent and a binder was applied to predetermined points on crests of the corrugated sheet. Then, the planar sheet and the corrugated sheet are placed on one another and wound together into a honeycomb core of ϕ40×L 90. The honeycomb core was inserted into and brazed to an outer tube in a vacuum furnace to provide a honeycomb unit for exhaust emission control. It is noted that the honeycomb core was brazed to the outer tube through brazing material.

The honeycomb core had inlet and outlet side joining portions brazing the corrugated sheet to the planar sheet. The inlet side joining portion had a brazing length of 5 mm from a location which was 4 mm away from an inlet end of the honeycomb core and the outlet side joining portion had a brazing length of 10 mm from a location which was 4 mm away from an outlet end of the honeycomb core.

Each of the inlet side joining portion and the outlet side joining portion included outer joining sections on an outer side of the corrugated sheet and inner joining sections on an inner side of the corrugated sheet. The outer joining sections and the inner joining sections were arranged in a staggered form with clearances (δ1*a*, δ1*b*) of 2 mm. It is noted that the joining sections on the outer side of the corrugated sheet were located on the side of the outlet end of the honeycomb core.

Nine samples of the honeycomb unit were prepared as shown in Table 2 below. These nine samples have different brazing lengths of joining strips of brazing material between the honeycomb core and the outer tube on inlet and/or outlet sides of the samples. Reference sign "-" in Table 2 means no brazing length. Namely, for example, in the sample J-(6), the honeycomb core was not brazed to the outer tube on the inlet side of the sample. In the sample H-(7), also, the honeycomb core was not brazed to the outer tube on the outlet side of the sample. Of these nine samples, the samples J-(6) to J-(9) were made in accordance with the present invention. The samples H-(6) to H-(10) were comparative ones. The brazing length (B1) of the joining strip on the outlet side of the sample is defined as a length from the outlet end of the honeycomb core of the sample.

Each of the samples was tested by undergoing vibrations of 20 G to 60 G in a temperature cycle process (1000 to 2000 cycles of high and low temperatures of 200° C. to 1000° C.) for evaluation of strength and cell deformation of the tested sample. The evaluation of strength of the sample was made based on amounts of cracks on the sample in comparison with a conventional standard. The evaluation of cell deformation of the sample was made in comparison with a conventional standard. In addition, an amount of brazing material used in each sample was evaluated. Based on the evaluated strength, cell deformation and amount of used brazing material, a comprehensive evaluation of the sample was made.

TABLE 2

| | Brazing Length | | Test Result | | | |
|---|---|---|---|---|---|---|
| | Inlet Side Between Core & Outer Tube | Outlet Side (B1) Between Core & Outer Tube | Strength | Cell Deformation | Amount of Brazing Materials Used | Comprehensive Evaluation |
| H-(6) | 20 | 20 | No Good | No Good | No good | No Good |
| J-(6) | — | 20 | Very Good | Good | Good | Very Good |
| H-(7) | 20 | — | Good | No Good | Good | No Good |
| H-(8) | — | 2 | No Good | Good | Very Good | No Good |
| H-(9) | — | 5 | No Good | Good | Very Good | No Good |
| H-(10) | — | 10 | No Good | Good | Very Good | No Good |
| J-(7) | — | 15 | Good | Good | Good | Good |
| J-(8) | — | 25 | Very Good | Good | Fair | Good |
| J-(9) | — | 30 | Very Good | Good | Fair | Good |

Table 2 shows the test result indicating the evaluation of the strength and cell deformation, the evaluation of the amount of brazing material used and the comprehensive evaluation for each sample.

Table 2 indicates that the sample H-(6) with the honeycomb core brazed to the tube through the joining strips on both inlet and outlet sides thereof provides very poor strength because it is not possible that the honeycomb core is elongated to direct thermal stress in a direction of elongation of the core. Table 2 also indicates that the sample H-(7) with the honeycomb core brazed to the outer tube through the joining strip only on an inlet side thereof provides a poor evaluation of the cell deformation because cell deformation is heavier than the conventional standard. The samples J-(6) to J-(9) each have the honeycomb core and the outer tube brazed together through the joining strip disposed only on the outlet side thereof.

The test result in Table 2 shows that the strength is better when the brazing length is 15 mm or more, and is insufficient when the brazing length is 10 mm or less. A study of the cause of the insufficient strength shown in Table 2 reveals that the insufficient strength results from damage concentrated at the joining strip when the length of the joining strip is equal or smaller than a brazing length of a joining portion of the honeycomb core. Thus, the length of the joining strip between the honeycomb core and the outer tube needs to be larger than the length of the joining portion of the honeycomb core.

Example 3

A planar sheet was prepared. A 40 μm stainless steel foil sheet was machined to provide a corrugated sheet. Paste of brazing material prepared from a solvent and a binder was applied to predetermined points on crests of the corrugated sheet. Then, the planar sheet and the corrugated sheet are placed on one another and wound together into a honeycomb core of ϕ40×L 90. The honeycomb core was inserted into and brazed to an outer tube in a vacuum furnace to provide a honeycomb unit for exhaust emission control. It is noted that the honeycomb core was brazed to the outer tube through a joining strip of brazing material.

The honeycomb core had inlet and outlet side joining portions brazing the corrugated sheet to the planar sheet. The inlet side joining portion had a brazing length of 5 mm from a location which was 4 mm away from an inlet end of the honeycomb core and the outlet side joining portion had a brazing length of 10 mm from a location which was 4 mm away from an outlet end of the honeycomb core.

Each of the inlet side joining portion and the outlet side joining portion included outer joining sections on an outer side of the corrugated sheet and inner joining sections on an inner side of the corrugated sheet. The outer joining sections and the inner joining sections were arranged in a staggered form with clearances (δ1*a*, δ1*b*) of 2 mm. It is noted that the joining sections on the outer side of the corrugated sheet were located on the side of the outlet end of the honeycomb core.

Six samples of the honeycomb unit were prepared as shown in Table 3 below. The samples had 20-mm-length joining strips which are located different distances away from outlet ends of the samples. Of these six samples, the samples J-(10) and J-(11) were made in accordance with the present invention, and the samples H-(11) to H-(14) were comparative examples.

Each of the samples was tested by undergoing vibrations of 20 G to 60 G in a temperature cycle process (1000 to 2000 cycles of high and low temperatures of 200° C. to 1000° C.) to evaluate strength and cell deformation of the tested sample. In addition, an amount of brazing material used in each sample was evaluated. Based on the evaluated strength, cell deformation and amount of used brazing material, a comprehensive evaluation of the sample was made.

TABLE 3

| | Joining Strip Distance From Core Outlet End | Test Result Strength | Comprehensive Evaluation |
|---|---|---|---|
| J-(10) | 0 | Very Good | Very Good |
| J-(11) | 3 | Good | Good |
| H-(11) | 5 | No Good | No Good |
| H-(12) | 10 | No Good | No Good |
| H-(13) | 15 | No Good | No Good |
| H-(14) | 20 | No Good | No Good |

From Table 3, it was found that the joining strip between the honeycomb core and the outer tube is preferably located as close to the outlet end as possible because it is necessary to allow thermal stress in the honeycomb core to be directed in the direction of elongation of the honeycomb core. The joining strip should be arranged so that the end of the joining strip is not aligned with the end of the joining portion of the honeycomb core. This is because alignment of the end of the joining strip with the end of the joining portion causes concentration of stress which would lead to reduction in the strength of the honeycomb unit. Thus, the end of the joining strip is to be located rearward of the end of the joining portion. In the present invention, the end of the joining strip is 5 mm or less from the outlet end.

Example 4

A planar sheet was prepared. A 40 μm stainless steel foil sheet was machined to provide a corrugated sheet. Paste of brazing material prepared from a solvent and a binder was applied to predetermined points on crests of the corrugated sheet. Then, the planar sheet and the corrugated sheet are placed on one another and wound together into a honeycomb core of ϕ40×L 90. The honeycomb core was inserted into and brazed to an outer tube in a vacuum furnace to provide a honeycomb unit for exhaust emission control. It is noted that the honeycomb core was brazed to the outer tube through a joining strip of brazing material.

The honeycomb core had inlet and outlet side joining portions brazing the corrugated sheet to the planar sheet. The inlet side joining portion had a brazing length of 5 mm from a location which was 4 mm away from an inlet end of the honeycomb core and the outlet side joining portion had a brazing length of 10 mm from a location which was 4 mm away from an outlet end of the honeycomb core.

Each of the inlet side joining portion and the outlet side joining portion included outer joining sections on an outer side of the corrugated sheet and inner joining sections on an inner side of the corrugated sheet. The outer joining sections and the inner joining sections of the respective inlet and outlet joining portions were arranged in a staggered form with clearances (δ1*a*, δ1*b*). It is to be noted that the clearance for the outer and inner joining sections of the inlet side joining portion is the same as the clearance for the outer and inner joining sections of the outlet side joining portion. It is also noted that the joining sections on the outer side of the corrugated sheet were located on the side of the outlet end of the honeycomb core.

The joining strip between the honeycomb core and the outer tube was located only on the side of the outlet end of the honeycomb core and had a length of 20 mm from the outlet end of the honeycomb core.

Eight samples of the honeycomb unit were prepared as shown in Table 4 below. As shown in Table 4, the eight samples have different clearances (δ1*a*, δ1*b*) with which the outer joining sections and the inner joining sections were arranged in the staggered form. Of these eight samples, the samples J-(12) to J-(16) were made in accordance with the present invention. The samples H-(15) to H-(17) were comparative ones.

Each of the samples was tested by undergoing vibrations of 20 G to 60 G in a temperature cycle process (1000 to 2000 cycles of high and low temperatures of 200° C. to 1000° C.) for evaluation of strength and cell deformation of the tested sample. The evaluation of strength of the sample was made based on amounts of cracks on the sample in comparison with a conventional standard. The evaluation of cell deformation of the sample was made in comparison with a conventional standard. In addition, an amount of brazing material used in each sample was evaluated. Based on the evaluated strength, cell deformation and amount of used brazing material, a comprehensive evaluation of the sample was made.

TABLE 4

| | Clearance (δ 1a, δ 1b) | Test Result Strength | Comprehensive Evaluation |
|---|---|---|---|
| H-(15) | −5 | No Good | No Good |
| H-(16) | −2 | No Good | No Good |
| J-(12) | 0 | Good | Good |
| J-(13) | 1 | Very Good | Very Good |
| J-(14) | 2 | Very Good | Very Good |
| J-(15) | 3 | Very Good | Very Good |
| J-(16) | 4 | Good | Good |
| H-(17) | 10 | No Good | No Good |

From Table 4, it was found that the strength was poor with the outer joining sections overlapping the inner joining sections. This is because cracks would be developed at the outer and inner joining sections due to stress concentrated at the overlapping area having high rigidity. It was also found that each of the clearances (δ1*a*, δ1*b*) in the range of 0 to 4 mm provides sufficient strength. The strength is low when the clearances (δ1*a*, δ1*b*) are larger than 4 mm. This is because the larger clearances keep thermal stress from being directed in the axial direction of the honeycomb core as the honeycomb core is elongated in the axial direction of the honeycomb core. The optimal clearance was 2 mm. As a result, it turned out that each of the clearances (δ1*a*, δ1*b*) should be 0 to 4 mm, preferably, 1 to 3 mm.

Obviously, various minor changes and modifications of the present invention are possible in the light of the above teaching. It is therefore to be understood that within the scope of the appended claims the invention may be practiced otherwise than as specifically described.

What is claimed is:

1. A honeycomb unit for exhaust emission control, comprising:

a metal outer tube; and a metal honeycomb structure pressed into and joined to the metal outer tube, the metal honeycomb structure including:

a joining strip joined to the metal outer tube;

a planar sheet;

a corrugated sheet placed on the planar sheet, the corrugated sheet and the planar sheet being wound together, the corrugated sheet including an outer surface having crests and an inner surface having crests;

first and second joining portions brazing the planar sheet and the corrugated sheet together;

the first joining portion and the second joining portion being located proximate opposing ends of the metal honeycomb structure;

the first joining portion including first joining sections formed of brazing materials applied to the crests of the outer surface of the corrugated sheet and second joining sections formed of brazing materials applied to the crests of the inner surface of the corrugated sheet;

the second joining portion including first joining sections formed of brazing materials applied to the crests of the outer surface of the corrugated sheet and second joining sections formed of brazing materials applied to the crests of the inner surface of the corrugated sheet;

the first joining sections of the first joining portion and the first joining sections of the second joining portion being offset from the second joining sections of the first joining portion and the second joining sections of the second joining portion in directions parallel to an axis of the metal honeycomb structure;

the second joining portion and the joining strip overlapping, the first joining portion and the joining strip not overlapping;

the first joining portion having a first brazing length along the axis of the metal honeycomb structure;

the second joining portion having a second brazing length along the axis of the metal honeycomb structure; and the second brazing length of the second joining portion being larger than the first brazing length of the first joining portion;

wherein one of the opposing ends of the metal honeycomb structure defines an exhaust outlet of the honeycomb structure, and the joining strip is disposed only on a side of the exhaust outlet.

2. The unit of claim 1, wherein the first joining sections of the second joining portion are located on the side of the exhaust outlet, the first joining sections of the second joining portion have rear ends, and the joining strip has a rear end located rearward of the rear ends of the first joining sections of the second joining portion.

3. The unit of claim 1, wherein the first joining sections of the first joining portion are arranged adjacent the second joining sections of the first joining portion in directions parallel to the axis of the honeycomb structure without overlapping the second joining sections of the first joining portion in directions orthogonal to the axis of the honeycomb structure, and the first joining sections of the second joining portion are arranged adjacent the second joining sections of the second joining portion in directions parallel to the axis of the honeycomb structure without overlapping the second joining sections of the second joining portion in directions orthogonal to the axis of the honeycomb structure.

* * * * *